US005900795A

United States Patent [19]

Holmgren et al.

[11] Patent Number: 5,900,795

[45] Date of Patent: May 4, 1999

[54] CONTROLLABLE INDUCTOR

[75] Inventors: Tommy Holmgren, Ludvika; Erik Jansson, Borlänge, both of Sweden

[73] Assignee: Asea Brown Boveri AB, Vasteras, Sweden

[21] Appl. No.: 08/962,926

[22] Filed: Oct. 27, 1997

[30] Foreign Application Priority Data

Jan. 8, 1997 [SE] Sweden ..... 9700028

[51] Int. Cl.[6] ..... H01F 27/08; H01F 27/02

[52] U.S. Cl. ..... 336/55; 336/59; 336/60

[58] Field of Search ..... 336/55, 57, 59, 336/60

[56] References Cited

U.S. PATENT DOCUMENTS 2,942,213 6/1960 Camilli et al. ..... 336/60
3,008,108 11/1961 Baker et al. ..... 336/185
4,540,967 9/1985 Chitose ..... 336/84 C

FOREIGN PATENT DOCUMENTS 9411891 5/1994 WIPO .

*Primary Examiner*—Lincoln Donovan
*Assistant Examiner*—Anh Mai
*Attorney, Agent, or Firm*—Watson Cole Grindle Watson P.L.L.C.

[57] ABSTRACT

A controllable inductor comprises at least a tubular core (13) a main winding (5) surrounding the core, a control winding (13) passing substantially axially through the core, a ground part (15) arranged inside the main winding and an element surrounding the core and adapted to carry the main winding wound outside thereof at a distance to the ground part while creating a voltage taking air gap between the main winding and this part. The main winding has a first end (10) thereof on high potential and the potential falls towards the second opposite end (11). The element carries the main winding at the first end (10) at a larger radial distance to the ground part than at the second end.

17 Claims, 5 Drawing Sheets

CONTROLLABLE INDUCTOR

FIELD OF THE INVENTION AND PRIOR ART

The present invention relates to a controllable inductor comprising at least a tubular core, a main winding surrounding the core, a control winding passing substantially axially through the core and running back substantially axially outside thereof, a part connected to ground and arranged radially inside the main winding and an element surrounding the core and adapted to carry the main winding wound externally thereof at a distance from the part connected to ground while creating an air gap taking a voltage between the main winding and said part, said main winding being wound so as to have a first end thereof with respect to the axial direction on a high potential and the potential falling towards the second, opposite end.

Such a controllable inductor is normally used together with a capacitor so as to form a so called tuneable harmonic filter, in which said outer main winding is through the capacitor connected to a high voltage network in connection with a high voltage station for converting direct voltage to alternating voltage and conversely, the controllable inductor usually being connected to the alternating voltage side. In such a controllable inductor the permeability of its core and thereby the inductance will be adjusted by means of cross-magnetisation generated by the control winding, whereby the inductance of the inductor may be adapted to a specific frequency of a harmonic generated in the high voltage network by said conversion and intended to be faded out, for effective fade-out thereof causing small energy losses in the inductor. An inductor of this type is previously known through for example EP-C-0 010 502, SU-A-678 542 and WO 94/11891.

In this controllable inductors previously known one end of the very coil conductor or the main winding is on a high potential and this potential falls gradually towards the second end, which is connected to ground, while the very control winding functions as ground part or this is enclosed by a part connected to ground. The air gap between said part connected to ground and the main winding takes in these controllable inductors the voltage drop between the main winding and the ground part, and it is necessary that this air gap is that large, that the electric field strength therein at possible sudden strong voltage raises, so called surge voltages, will not get that high that there will be electric flash-overs from the conductor to the ground part, which may destroy the inductor with a serious risk for causing a fire. Such surge voltages emanates inter alia from very short atmospheric overvoltages, i.e. lightening strokes. These surge voltages are usually several times higher than the normal operation voltage of the net work, and it is extremely important that the inductor may stand these high surge voltages. As inductors of this type are large and expensive constructions it is a big disadvantage that the air gaps of the inductors previously known have to be made so large for fulfilling the demands with respect to surge voltages, and they become much more expensive than if their dimensions would have been smaller. A solution to this problem has being presented through the PCT-application PCT/SE97/00530 of the applicant, which describes a controllable inductor with an insulating member, which allows the air in an air gap between the insulating member and the main winding to be ionised for making said insulating member taking a part of the voltage drop between the main winding and the part connected to ground, so that the voltage drop in the air gap may be reduced.

Even if it is chosen to use an inductor of such a type which is well functioning and very competitive from the cost point of view, there are needs of showing ways to optimise the construction of such a controllable inductor in different aspects having the high costs associated with this types of apparatuses in mind, primarily for making it more cost efficient.

SUMMARY OF THE INVENTION

The object of the present invention is to provide a controllable inductor of the type defined in the introduction, which has features making it able to take care of surge voltages to which it may occasionally be excerted in a cost efficient way.

This object is according to the invention obtained by providing such a controllable inductor, in which said element is adapted to carry the main winding at the first end at a greater radial distance from said part connected to ground than at the second end. A better isolation at that end of the main winding at which the voltage is highest and the risk of possible harmful flash-overs is greatest is obtained by this, so that the inductor may be made more compact, primarily at said second end, and the demands on the ability to withstand surge voltages may still be fulfilled. This means a very cost efficient inductor construction.

According to a preferred embodiment of the invention said element is adapted to carry the main winding at a radial distance from said part increasing gradually towards the first end. By gradually increasing said radial distance towards that end at which the greatest radial distance is needed, it will be possible to keep this distance on an advantageous low level where that may be accepted and still take care of sudden surge voltages were these are highest.

According to an other preferred embodiment of the invention said element is adapted to carry the main winding at a substantially constant distance form said part over a certain axial distance from the second end and than so that said radial distance increases towards the first end. This constitutes a realisation of the idea according to the invention defined above by simple means.

According to another preferred embodiment of the invention said element is adapted to carry the main winding at a radial distance from said part increasing stepwisely towards the firs end. This embodiment may in some cases be advantageous from the manufacturing point of view, since it is possible to achieve said increase in that way by using element parts having radial dimensions being constant in the axial direction so as to form said element and keep the main winding at a constant distance outside the different element parts, which are connected to each other while forming steps.

According to another preferred embodiment of the invention said element is adapted to carry the main winding at a radial distance from said part increasing substantially continuously toward the first end from a radial plane of the main winding. Said distance may by this be increased towards the first end corresponding to the voltage increase between the main winding and said part.

According to another preferred embodiment of the invention the inductor comprises a first member of electrically insulating material adapted to screen said part connected to ground with respect to the main winding and which is arranged outside a control winding, and said element comprises means for holding the main winding outside the first insulating member. By arranging such an insulating member the advantages of lowering the voltage across the air gap, which are described in the PCT-application mentioned above, may be obtained so as to make the inductor more compact, at the same time as it is possible to utilise the insulating member as support for said element and means for holding the main winding should this be required.

According to another preferred embodiment of the invention the first insulating member is adapted to have a radial distance to a ground part being substantially constant in the axial direction, and said means is adapted to hold the main winding at different radial distances from the first insulating member for varying the radial distance between the main winding and the part connected to ground. This constitutes a simple and favourable construction of the inductor with respect to costs.

According to a further development of the embodiment last mentioned the part connected to ground is arranged on the innerside of the first insulating member. Such a ground plane on the insulating member, i.e. externally of the control winding, is advantageous, since the control winding normally being on ground without such a ground plane could mean that the entire control winding/core package would be damaged by a flash-over at a puncture of the insulation at any part of the control winding.

According to another preferred embodiment of the invention the inductor comprises a second insulating member arranged radially inside and at a distance from the first one, but outside the control winding, and the part connected to ground is arranged on the innerside of the second insulating member. The arrangement of two such insulating members means that each of these insulating members may at high surge voltages, which cause ionisation of the air therebetween, take a considerable part of the voltage drop between the ground part and the main winding, so that the distance between the ground part and the main winding may be made as small as possible, as is described in the PCT-application mentioned above.

According to another preferred embodiment of the invention the main winding is wound in radial layers, which are made of a plurality of turns of a conductor wound outside and onto each other and which are arranged in an axial direction with axial spaces between consecutive layers for transport of the cooling air of the main winding from said channel and out into said spaces between the layers. An efficient cooling of the main winding is obtained in this way.

Further advantages as well as advantageous features of the invention appear from the following description and the other dependent claims.

BRIEF DESCRIPTION OF THE DRAWINGS

With reference to the appended drawings, below follows a description of preferred embodiments of the invention cited as examples.

In the Drawings

DETAILED DESCRIPTION OF PREFERRED EMBODIMENTS OF THE INVENTION

Figure 1:
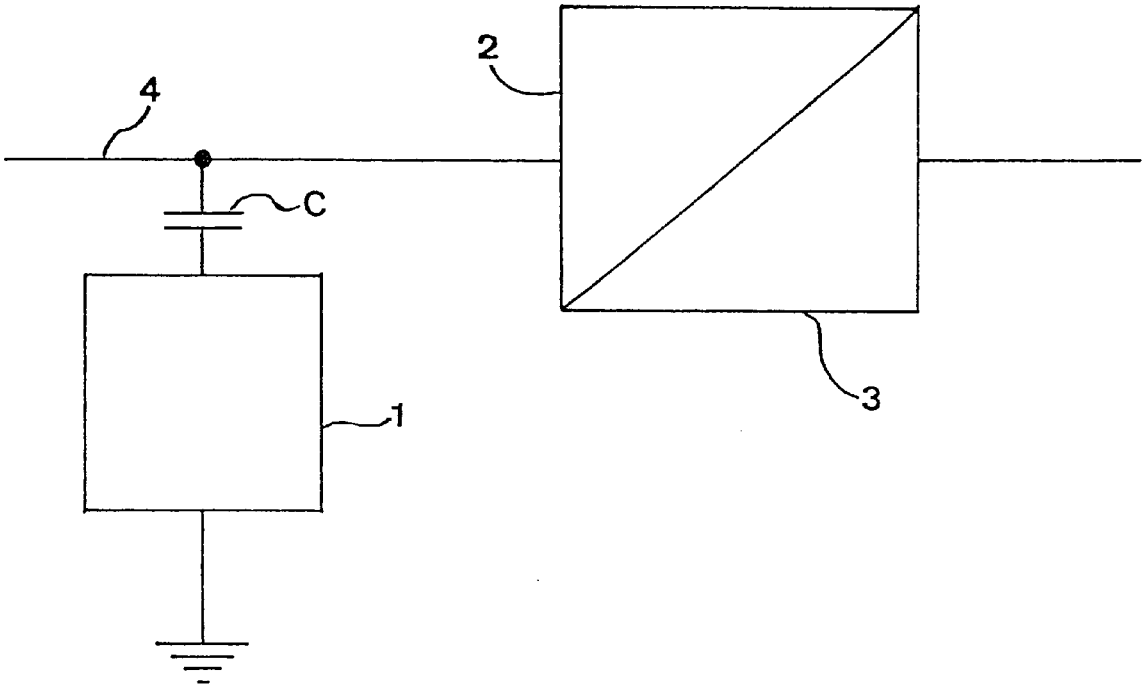
FIG. 1 is a very schematic block diagram illustrating were a controllable inductor according to the invention may be used.

A field of use for a controllable inductor 1 according to the invention is illustrated in FIG. 1, said inductor is through a capacitor C connected the alternating voltage side 2 of a station 3 for converting High Voltage Direct Current (HVDC) into alternating current and conversely alternating current into direct current. Different harmonic currents superimposing the alternating current leaving the station are formed in connection with such stations, and these harmonics may disturb the other apparatuses connected to the network. The controllable inductor functions together with a capacitor as a harmonic filter and fade-out these harmonics, in which it is intended to have a minimum impedance for exactly the frequency of the harmonic to be filtrated. Different loads on the network 4 at different points of time of the day may however result in somewhat varying frequencies of the alternating current, so that it is important that the inductance of the inductor may be controlled so as to all the time have the impedance minimum at the actual harmonic frequency, in which the inductor is connected to a regulation system for automatic adjustment of the control current of the inductor and by that the inductance thereof for minimising the impedance of the filter at the frequency prevailing.

Figure 2:
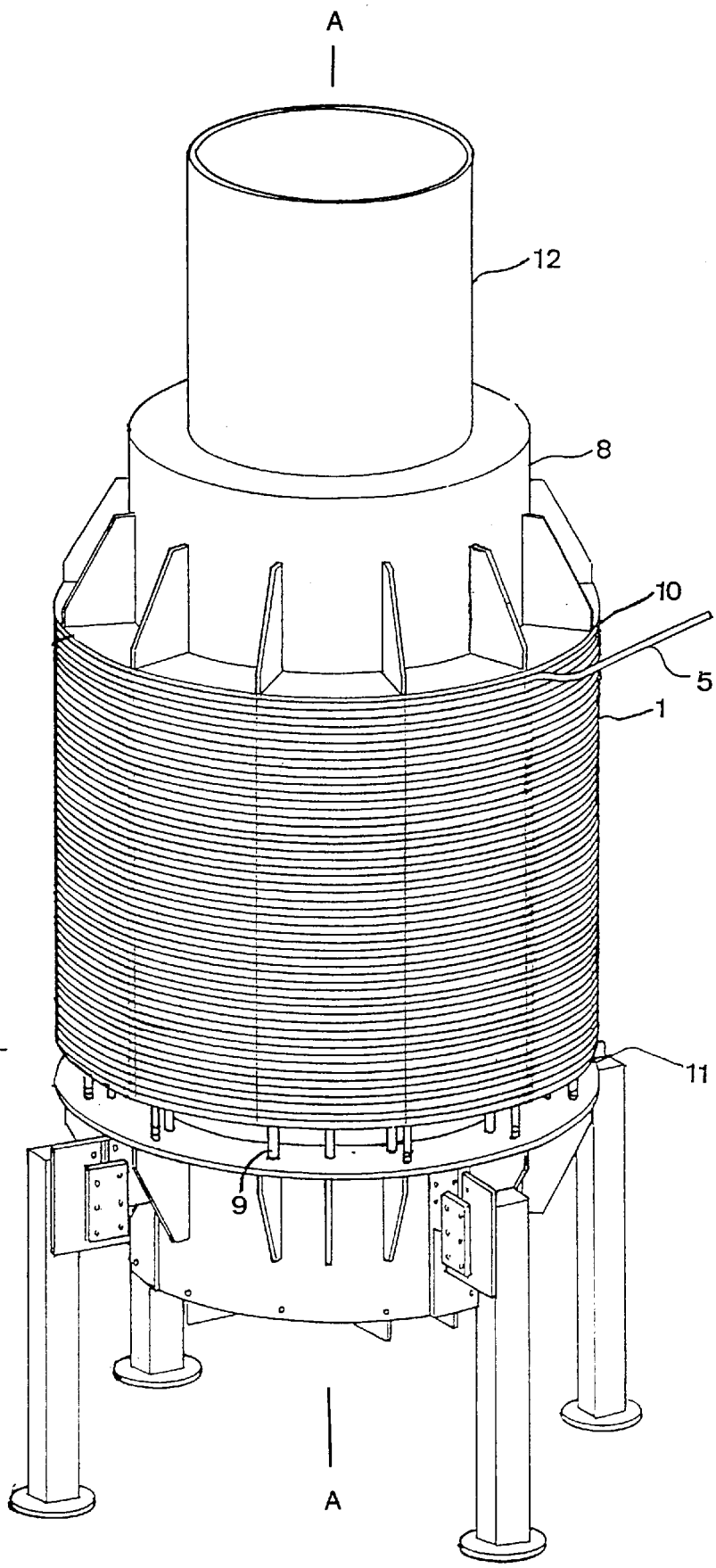
FIG. 2 is a perspective view of an inductor of the type according to the invention, which however has not the features primarily characterising the invention.
Figure 3:
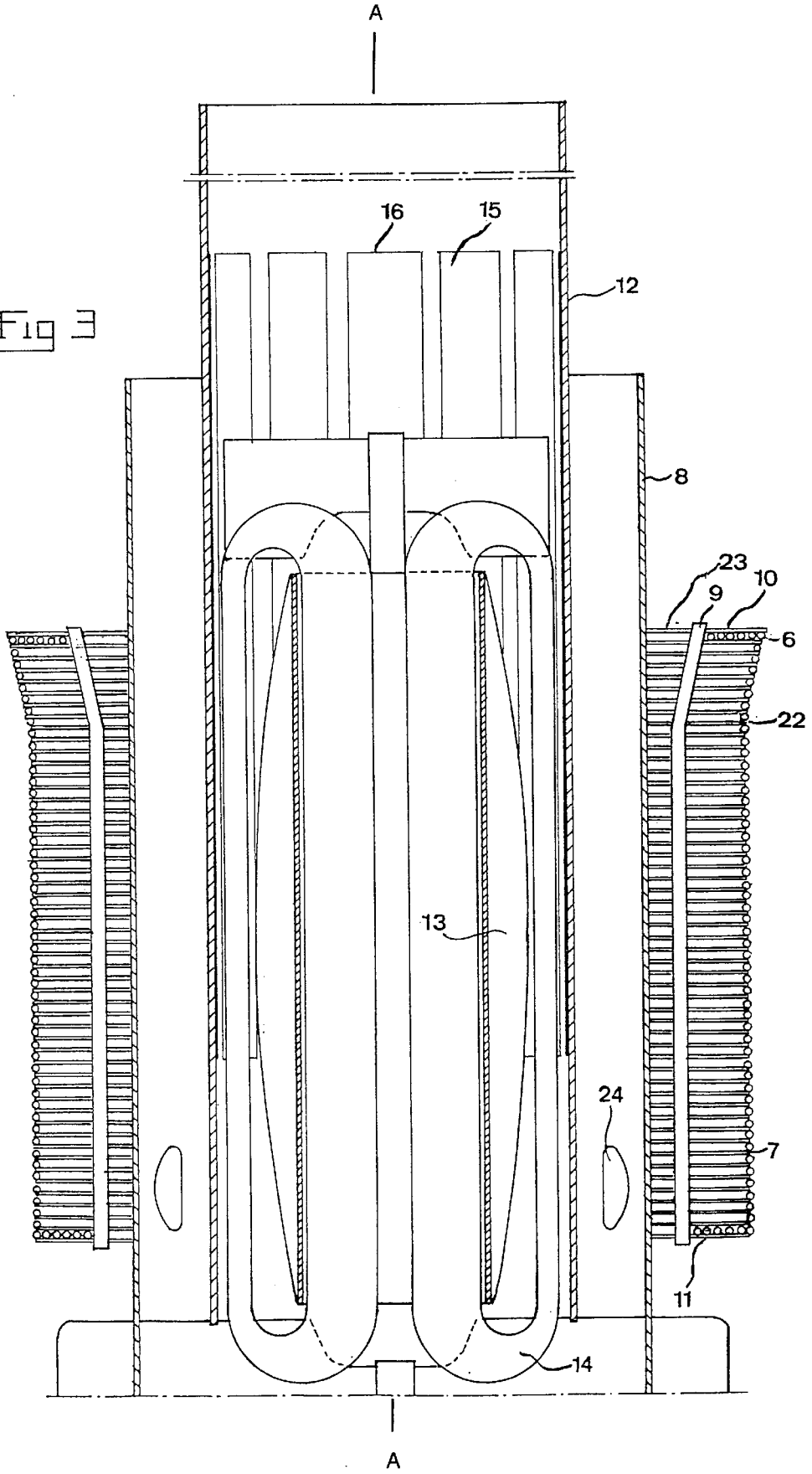
FIG. 3 is a partially sectioned simplified view illustrating the overall construction of a controllable inductor of the type as the one shown in FIG. 2, but according to a first preferred embodiment of the invention.

Reference is now made to FIG. 2, where the general construction of a controllable inductor of the type according to the invention having a control axis 4 is illustrated. The inductor has a main winding 5 intended to be connected to a high potential and which is formed by winding one conductor in a plurality of turns from the inside and outwardly and from the outside and inwardly in radial layer 6, which succeed in the axial direction. Reference is now also made to FIG. 3, which shows an inductor being identical to that according to FIG. 2 except for one point, which will be described further below. Not all but only the outer winding turns have for the sake of simplicity, except for the layers located at the ends, been shown in the drawings. Furthermore the inductor has an element adapted to carry the main winding, and this has means in the form of plates 7 carrying the radial layers and arranged mutually spaced in the axial direction, said plates bearing upon a cylinder 8, here called the first insulating member, of an electrically insulating material. The inductor has also members 9 in the form of rods for forming radial supports for the inner winding turn of the respective layer 6 so as to keep this at a distance from the outer wall of the first insulating member and form an air gap therebetween. The main winding 5 has a first end 10 with respect to the axial direction on a high potential, in which the voltage falls in the direction towards the opposite second end 11, which is on ground potential. Inside of and coaxially to the first insulating member 8 there is a second insulating member 12 in the form of a cylinder of electrically insulating material. In the room defined by the cylinder 12 a core 13 of magnetic material is arranged coaxially thereto.

This core has a partially conical form at its ends, which is intended to reduce the eddy current losses generated in the core as a consequence of the alternating harmonic current in the main winding 5. This phenomena is described in WO 94/11891 of the applicant. The control winding 14, which preferably is formed by a plurality of separate part control windings, passes substantially axially through the core and substantially in parallel in the axes thereof back in the space between the core and the second insulating member 12 in a closed loop. The control winding 14 is connectable to a direct current source, but the use of an alternating current would also be conceivable, for sending a direct current therethrough, which would generate a tangentially directed magnetic flow in the core, which extends transversely to the longitudinal alternating flow and in that way reduce the permeability of the core for the longitudinal magnetic flow from the main winding. By increasing this direct current the permeability of the core may be reduced and by that the inductance of the inductor be reduced. A lower permeability of the core means also that it may store more energy therein per volume unit, so that the inductor may be made more compact.

On the innerside of the second cylinder 12 a part 15 connected to ground and called ground plane is applied, which is formed by elongated strips 16 of electrically conducting material having its longitudinal direction substantially in the axial direction with respect to the core. These strips 16 are interconnected through a strip 17 extending transversely to the rest of the strips (see FIG. 5), which is adapted to electrically connect the strips 16 to each other. Contact members not shown directly connected to ground are arranged inside the room surrounded by the second cylinder 12 and to resiliently bear against the strip 17 for connecting the ground part 15 with ground irrespectively of how the second cylinder 12 is turned when the inductor is assembled. The ground part 15 is preferably formed by applying an electrically conducting paint on the innerside of the cylinder 12.

Figure 4:
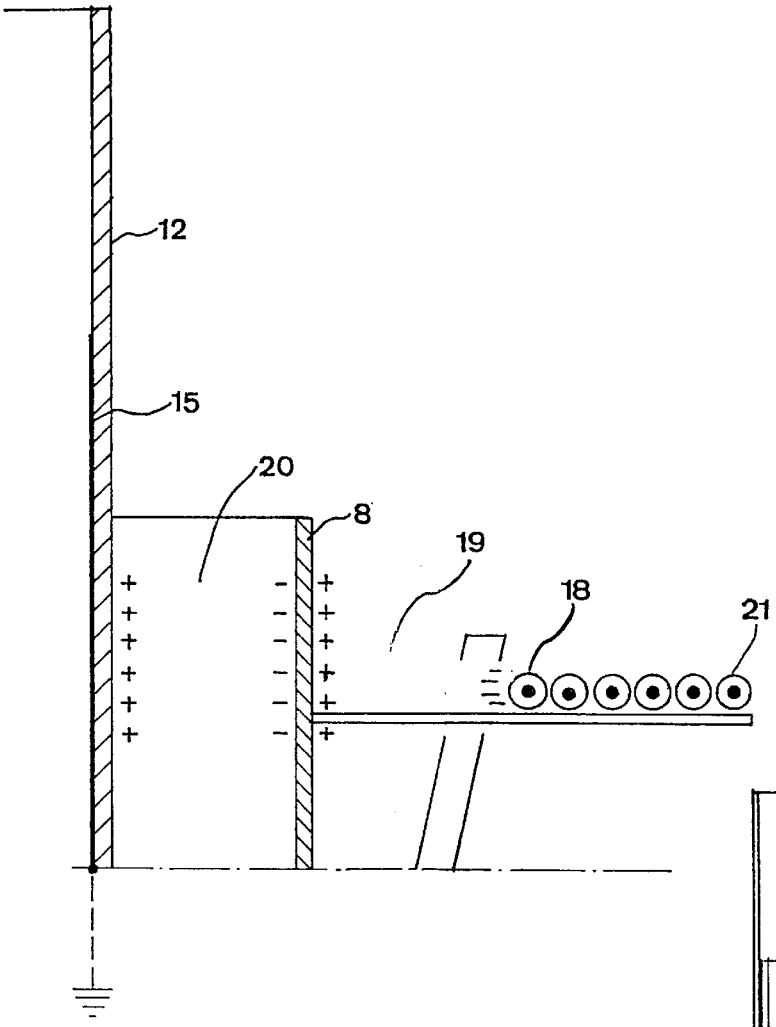
FIG. 4 is an enlarged view with respect to FIG. 3 of a part of the inductor in FIG. 3, in which the proportions have been made different so as to gain place in the drawing.

Reference is now also made to FIG. 4. Only the upper winding layer of the main winding 5 is shown in FIG. 4, and it is especially the inner turn of this layer that is particularly exposed, since it is on the high voltage potential and closes to a part 15 connected to ground. The problem that will be described below will be less accentuated the closer the main winding 5 gets to the second end 11, which is the explanation to why the first cylinder 8 and the ground part 15 are not extending so far at that end as at the high voltage end 10. In normal operation of the inductor the inner conductor 18 may be on a potential of for example 75 kV, and the voltage between this conductor 18 and the ground part 15 is substantially taken by the air gaps 19, 20 separating them. However, when suddenly a surge voltage occurs as a consequence of atmospheric disturbances or switchings in the new work, the conductor 18 may for a very short time arrive at a far higher voltage level, such as for example 450 kV. Normally, i.e. in inductors known before the birth of the invention according to our PCT-application PCT/SE97/00530, the air gap between the conductor 18 and a ground part of the inductor, which could have been the very control winding, has been dimensioned so that the electric field strength established in the air gap at such surge voltages will not get that high at any ionisation of the air and by that flash-overs between the conductor 18 and the ground pat 15 takes place, since such an flash-over could result in a perforation of the insulating layer 21 of the conductor 18 and a short circuit as produced therefrom to the ground part. This was identical to a requirement of very large air gaps between the conductor 18 and the ground part. However, through the invention according to the PCT-application last mentioned this air gap could been reduced considerably and a remarkably more compact inductor could have been produced, and the characteristics enabling this are also there in the inductor according to the embodiments of the present invention shown in the drawings. More exactly, the ground part 15 is here screened with respect to the conductor 18 through the two insulating members 8 and 12. This arrangement has resulted in the possibility to locate the conductor 18 closer to the ground part 15, i.e. with a smaller air gap therebetween than in inductors according to the prior art. It is namely so that this arrangement allows an occurrence of such high field strengthes at a surge that the air molecules in the air gap 19, 20 are ionised, since the electric charges formed thereby may be received on the surfaces of the different insulating members and on the outside of the insulating layer 21, wherethrough voltage drops arises across the thickness of the insulating layer and the thicknesses of the insulating members 8 and 12. This means in its turn that the voltage drop in the air gaps 19, 20 is lower. The surface charge on the insulating material will in this case at a too high voltage drop, i.e. an increasing ionisation, become to large and dischargings takes place over the surface of the coil. This takes place with a reasonably thick conductor insulation without any puncture of the conductor insulation.

However, the inductor may through the present invention be made even more compact while meeting the demands of capability to withstand surge voltages. This is more exactly achieved by designing the element carrying the main winding to do this at a first end 10, which is located on a high potential, at a larger radial distance from the part 15 connected to ground than at a second end 11, which is connected to a low potential or ground. In the first preferred embodiment of the invention illustrated in FIGS. 3 and 4 this is achieved by making the rods 9 functioning as spacers between the first insulating member 8 and the main winding 5 and by that indirectly between the main winding and the ground part 15 to diverge outwardly away from the ground part at the first end. The plates 7 carry here through the rods 9 the main winding at a substantially constant radial distance to the ground part over a certain axial distance from the second end 11, and the radial distance therebetween then increases substantially continuously towards the first end 10 through an angle of the rods 9 from a point 22. The point 22 is located at a distance to the first end 10 exceeding 10% of the distance between the first and second ends 10 and 11, respectively, more exactly the distance between the two ends is in a particular embodiment about 1 200 mm and the point 22 is located at an axial distance of 200 mm to the first end 10. Furthermore, the radial distance between the innermost winding turn of the respective layer of the main winding and the external wall of the first insulating member 12 is in that embodiment 335 mm between the second end 11 and the point 22, while this distance increases to 375 mm to the first end 10. This means that the rods 9 are bent in an angle of about 11°. By increasing the radial distance and by that the size of the air gap between the main winding and the part connected to ground exactly where the voltage is highest in this way, it is possible to let this air gap be comparatively small in the parts where the voltage stresses are not that high, but the voltage stresses may well be taken where they are highest. This leads to a very compact and cost-efficient design of the controllable inductor or the air inductor, as it is called because the longitudinal magnetic flow is closed in the air.

Figure 5:
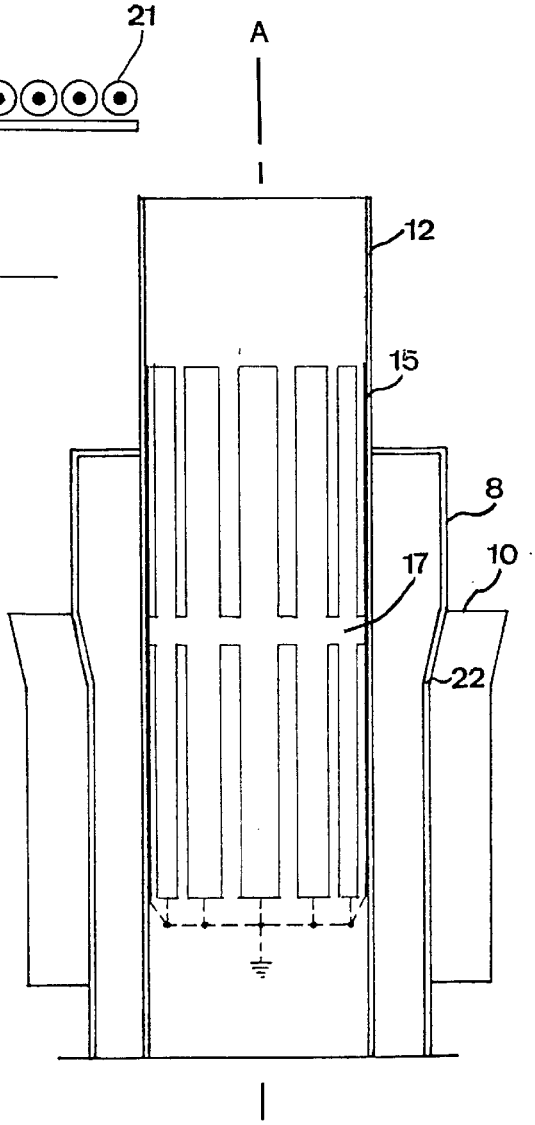
FIG. 5 is a simplified partially sectioned view of an inductor according to a second preferred embodiment of the invention, in which a series of components have been removed for illustrating the overall construction of the inductor and the proportions between different components belonging thereto.

An inductor according to a second preferred embodiment of the invention is illustrated in FIG. 5, which differs from that shown in FIG. 3 by the fact that it is the insulating member 8 that here has a radial distance to the ground part 15 increasing continuously from the point 22 towards the first end 10, so that the radial distance between the main winding and this insulating member 8 and by that the length of the plates 7 is here substantially constant. The same effect as in the embodiment according to FIG. 3 is obtained through this design, but the embodiment according to FIG. 5 may perhaps be preferred in certain cases. It may for example be mentioned that the controllable inductor preferably has members not shown for generating the flow of air upwardly in a channel 23 surround the first insulating member 8 between the first insulating member 8 and the main winding, and this channel gets in the design according to FIG. 5 a substantially constant cross section. It may be mentioned that the air flows out in the channel through openings 24 (see FIG. 3) in the wall of the insulating member 8.

Figure 6:
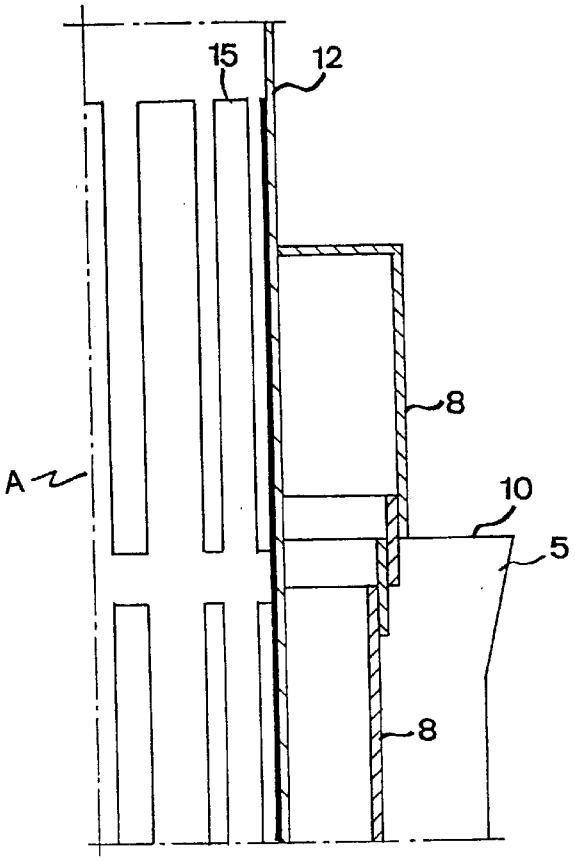
FIG. 6 is an enlarged view with respect to FIG. 5 of a part of an inductor according to a third preferred embodiment of the invention and, FIG. 7 is an enlarged detail view of a part of an inductor according to a fourth preferred embodiment of the invention.

A third way to achieve said increase of the radial distance is schematically illustrated in FIG. 6, and this is here made by constructing the element in question to carrying the main winding at a radial distance to the ground part 15 increasing stepwisely towards the first end 10. Thus, this has been achieved by constructing the second insulating member by a plurality of part cylinders having different diameters. This may in certain cases be an advantageous possibility to realise the invention from the manufacturing technical point of view.

Figure 7:
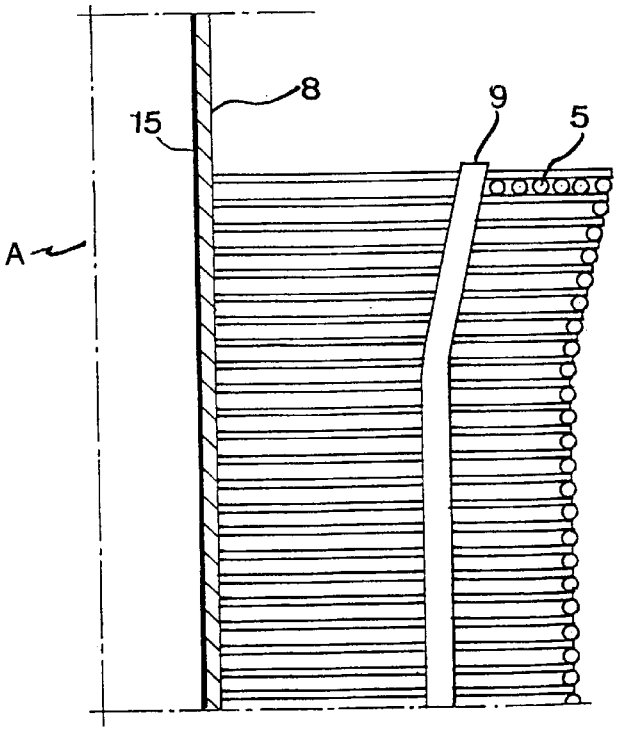

It is illustrated in FIG. 7 how according to a fourth preferred embodiment of the invention the second insulating member has been omitted and the first insulating member 8 has instead been provided with the part 15 connected to ground on the innerside thereof, which has resulted in a very large air gap 19 between the first insulating member and the main winding. This embodiment differs for the rest not from that shown in FIG. 3. This embodiment without the additional insulating barrier which is there in the other embodiments, may be an alternative for lower surge voltages. For higher voltages there will otherwise be a requirement of very long heels or plates in towards the first insulating member.

The invention is of course not in any way restricted to the preferred embodiments described above, but many possibilities to modifications thereof would be apparent to a man with ordinary skill in the art without departing from the basic idea of the invention.

It is for example well within the scope of the invention to not have any part connected to ground arranged outside the control winding but letting the very control winding form the part connected to ground, even though this is a disadvantage, since a puncturing of the insulation on the control winding and a flash-over following thereupon could lead to a damage of the entire control winding/core package.

It would also be conceivable to combine the different embodiments with each other so that the distance between the first insulating member and the main winding and between the first insulating member and the part connected to ground increase towards the first end of the main winding. It would of course also be possible to have any of these decreasing, as long as the net effect will be that the distance between the main winding and the ground part increases.

It is also within the scope of the invention that said distance increase is achieved by modifying the radial extension of the ground part in the axial direction, even if the ground part in most cases will be comparatively strongly restricted in this respect.

It is of course also possible that the distance between the main winding and the part connected to ground increases all the way from the second to the first end, in which it however is possible that this does not take place continuously but in different steps. Furthermore, the ground part may of course have a completely different extension than what is shown in the figures and may very well in the axial direction extend past the lower end of the main winding.

We claim:

1. A controllable inductor comprising a tubular core, a main winding surrounding the core, a control winding passing axially through the core and running back axially outside thereof, a cylindrical part connected to ground and arranged radially inside the main winding and a support element surrounding the cylindrical part and for carrying the core the main winding being wound externally on the support element at a distance from the cylindrical part creating an air gap therebetween for a selected voltage between the main winding and said cylindrical part, said main winding being wound so as to have a first end thereof at a relatively high potential and the potential falling towards the second, opposite end, wherein said support element carries the main winding at the first end at a greater radial distance from said cylindrical part and said second end being connected to ground.

2. An inductor according to claim 1, wherein said element is adapted to carry the main winding (5) at a radial distance from said part (15) increasing radially toward the first end (10).

3. An inductor according to claim 1 wherein said element is adapted to carry the main winding (5) at a substantially constant distance from said part (15) over a certain axial distance from the second end (11) and then so that said radial distance increases towards the first end (10).

4. An inductor according to claim 3, wherein said element is adapted to carry the main winding (5) at said substantially constant distance to the ground part (15) over more than the half of the axial distance from the second end (11) to the first end (10).

5. An inductor according to claim 1, wherein said support element carries the main winding at a radial distance from said cylindrical part increasing stepwisely towards the first end.

6. An inductor according to claim 1, wherein said support element carries the main winding at a radial distance from said cylindrical part increasing substantially continuously towards the first end.

7. An inductor according to any of claims 1 wherein said element is adapted to carry the main winding (5) at the first end (10) at a radial distance from the ground part (15) exceeding the corresponding distance at the second end (11) with more than 10%.

8. An inductor according to claim 1 comprising a first member of electrically insulating material for screening said cylindrical part connected to ground with respect to the main winding and arranged outside the control winding, and said support element comprises means for holding the main winding outside the first insulating member.

9. An inductor according to claim 8, wherein the first insulating member (8) is adapted to have a radial distance to the ground part (15) being substantially constant in the axial direction, and that said means is adapted to hold the main winding at different radial distances from the first insulating member (8) for varying the radial distance between the main winding (5) and the part (15) connected to ground.

10. An inductor according to claim 9, wherein the part (15) connected to ground is arranged on the innerside of the first insulating member (8).

11. An inductor according to claim 8, wherein said first insulating member has a greater radial distance to the cylindrical part connected to ground at the first end than at the second end.

12. An inductor according to claim 11, wherein the insulating member has radial dimensions increasing towards the first end of the main winding.

13. An inductor according to any of claims 8 wherein it comprises a second insulating member (12) arranged radially inside and at a distance to the first one (8), but outside the control winding (14) and that the part (15) connected to ground is arranged on the innerside of the second insulating member.

14. An inductor according to any of claims 8 wherein the first insulating member (8) is adapted to define a channel (23) extending substantially axially for conducting air for cooling the main winding (5) externally thereof between itself and the main winding.

15. An inductor according to claim 14, wherein the main winding (5) is wound in radial layers (6), which are made of a plurality of turns of a conductor wound outside and onto each other and which are arranged in the axial direction with axial spaces between consecutive layers for transport of air cooling the main winding from said channel and out into said spaces between the layers.

16. An inductor according to any of claims 1 wherein the control winding (14) is the part connected to ground.

17. A controllable inductor comprising a tubular core having a central axis, a support element, a main winding surrounding the core carried by the support element, a control winding passing axially through the core and running back axially outside thereof, a cylindrical part connected to ground and arranged radially inside the main winding, the main winding wound externally on the support element at a distance from the cylindrical part forming an air gap between the support element and the cylindrical part, said main winding being wound so as to have a first end at a relatively high potential and the potential falling towards a second opposite end, the first end at a greater radial distance from said cylindrical part than at the second end.

* * * * *